US005541999A

United States Patent [19]

Hirai

[11] Patent Number: 5,541,999

[45] Date of Patent: Jul. 30, 1996

[54] AUDIO APPARATUS HAVING A KARAOKE FUNCTION

[75] Inventor: Jun Hirai, Kyoto, Japan

[73] Assignee: Rohm Co., Ltd., Kyoto, Japan

[21] Appl. No.: 495,027

[22] Filed: Jun. 27, 1995

[30] Foreign Application Priority Data

Jun. 28, 1994 [JP] Japan ..... 6-146035

[51] Int. Cl.[6] ..... H04H 5/00

[52] U.S. Cl. ..... 381/2; 381/1; 381/107

[58] Field of Search ..... 381/107, 104, 381/1, 26, 2

[56] References Cited

U.S. PATENT DOCUMENTS 4,953,212 8/1990 Otsubo ..... 381/1

*Primary Examiner*—Curtis Kuntz

*Assistant Examiner*—Minsun Oh

*Attorney, Agent, or Firm*—Nikaido, Marmelstein, Murray & Oram LLP

[57] ABSTRACT

An audio apparatus having a plurality of modes as a karaoke reproduction to superimpose a sound signal from a microphone on an audio signal from a stereo sound source. A subtracting circuit is provided which obtains the difference between left and right channel signals from the sound source. A first changeover circuit selectively outputs the left and right channel signals to first and second terminals in a combination in accordance with a mode. A second changeover circuit is connected to the output of the subtracting circuit and to at least one of the left and right channel signals and selectively outputs a subtraction signal and a signal on the line to which the second changeover circuit is connected, to a third terminal. A third changeover circuit selectively outputs signals at the first, second and third terminals to fourth and fifth terminals according to the modes.

6 Claims, 2 Drawing Sheets

AUDIO APPARATUS HAVING A KARAOKE FUNCTION

BACKGROUND OF THE INVENTION

1. Field of the Invention

The present invention relates to an audio apparatus, and more particularly, to an audio apparatus suitable for karaoke.

2. Description of the Prior Art

Karaoke which was invented in the United States as "Music Minus One" for practicing classical symphonies and songs has remarkably been developed for singing popular songs for pleasure in Japan. With the development, karaoke not only is reimported to the United States but also is drastically spreading in various countries in Asia and Europe. In view of such spread, makers have been developing various functions for audio apparatuses for karaoke.

As an example of such an apparatus, a conventional audio apparatus will hereinafter be described. Referring to FIG. 1, there is shown a schematic block diagram of a relevant portion of the conventional audio apparatus. Reference numerals 1 and 2 represent a left input terminal and a right input terminal for receiving sound signals of the left and right channels from external apparatuses, respectively. Reference numerals 3 and 4 represent a left amplifier and a right amplifier which amplify sound signals received by the left and right input terminals 1 and 2.

Reference numeral 5 represents a microphone terminal for receiving vocal signals from a microphone 5*a*. The microphone terminal 5 is connected to a detecting circuit 6. Reference numeral 7 represents a control input terminal connected to a logical circuit 8. Reference numeral 9 represents a vocal canceling circuit.

Reference numeral 10 represents a switch controlled by a ternary control signal Sc outputted by the logical circuit 8. The switch 10 selects a terminal A and a terminal D when the signal Sc is of high voltage level (hereinafter, referred to as "H level"), selects a terminal B and a terminal E when the signal Sc is of middle voltage level (hereinafter, referred to as "M level") and selects a terminal C and a terminal F when the signal Sc is of low voltage level (hereinafter, referred to as "L level". Reference numerals 11 and 12 represent a left buffer circuit and a right buffer circuit. Reference numerals 13 and 14 represent a left output terminal and a right output terminal. Although not shown, for example, a signal from the microphone 5*a* and the left and right sound signals are transmitted by way of a mixing circuit and a power amplifier to a speaker to be outputted as sounds. Reference numeral 15 represents an order circuit controlled by operation buttons 15*a*, 15*b* and 15*c*.

An operation of the conventional audio apparatus thus structured will be described. To the left and right input terminals 1 and 2, stereo sound outputs of an apparatus such as a laser disk player, a compact disk player and a video cassette recorder are coupled.

The left and right sound signals are outputted as left and right signals Sl and Sr through the left and right amplifiers 3 and 4, respectively. The left signal Sl is coupled to the terminals A and F of the switch 10 and the right signal Sr is coupled to the terminals C and D. In addition, the signals Sl and Sr are transmitted to the vocal canceling circuit 9. The vocal canceling circuit 9 performs one-to-one subtraction of the signals Sl and Sr. The result is supplied to the terminals B and D of the switch 10 as an accompaniment signal Svc where the vocal of the singer recorded on a disk or a magnetic tape on the left and right channels in the same phase and amplitude is canceled.

In the normal music reproduction, the buttons 15*a* and 15*b* are not depressed and the control signal Sc is of H level. Thereby, the switch 10 is connected to the terminals A and D and the left and right sound signals merely pass the switch 10 and are supplied from the left and right output terminals 13 and 14 through the buffer circuits 11 and 12, respectively.

When the user enjoys karaoke with this apparatus, the following two cases are dealt with: a first case where so-called "sound multiple karaoke" is reproduced; a second case where a sound source other than karaoke is used as karaoke by canceling the vocal of the singer by using the vocal canceling circuit 9 so that only accompaniment signals are left.

In the first case, since only the accompaniment signals are recorded on the left channel and both the accompaniment signals and model vocal signals are recorded on the right channel, the user depresses the button 15*a* so that his or her selection is transmitted to the logical circuit 8 by the order circuit 15. Consequently, the control signal Sc is of L level so that the switch 10 selects the terminals A and F. As a result, only the accompaniment signals are outputted from the left and right output terminals 13 and 14 through the left and right buffer circuits 11 and 12. Hereinafter, this case will be referred to as "sound multiple mode".

In the second case, the button 15*b* is depressed and the control signal Sc is of M level, so that the switch 10 selects the terminals B and E. As a result, the accompaniment signal Svc is outputted from the left and right output terminals 13 and 14 through the left and right buffer circuits 11 and 12. Hereinafter, this case will be referred to as "vocal canceling mode".

The above-described are cases where the user enjoys reproduced music and karaoke in the normal manner. As an additional function, a function called "vocal assisting mode" is provided. According to this function, when the user who is singing to karaoke forgets the words and cannot sing any more, vocal signals from the sound source are outputted together with the accompaniment signals.

Specifically, the detecting circuit 6 detects that the level of the input from the microphone 5*a* becomes a predetermined level or below and outputs a detection signal Sd. The detection signal Sd is transmitted to the logical circuit 8 and when the button 15*c* representative of the vocal assisting mode is depressed, forcibly switches the level of the control signal Sc to low in the sound multiple mode and to high in the vocal canceling mode.

Thereby, music including the vocal of the singer is outputted from the left and right output terminals 13 and 14 at a pause of the sound from the microphone 5*a*.

With the above-described conventional arrangement, however, the vocal assisting mode cannot be employed for a sound source called "reverse sound multiple karaoke" which is one of the karaoke sound sources on the market. In this sound source, reversely to the above-described sound multiple karaoke, only the accompaniment is recorded on the right channel and both the accompaniment and model vocal are recorded on the left channel.

Even if it is possible for the user to reverse the connection of the left and right input terminals 1 and 2 in some form to enjoy the reverse sound multiple karaoke, it is very inconvenient to change the connection of the terminals for each karaoke sound source.

SUMMARY OF THE INVENTION

An object of the present invention is to provide a convenient audio apparatus employable for various karaoke sound sources on the market and not requiring the user to perform any additional operations.

An audio apparatus of the present invention has a plurality of modes as a karaoke reproduction to superimpose a sound signal from a microphone on an audio signal of a stereo sound source to be supplied to a speaker. The audio apparatus is provided with the following: a first line on which a left channel signal is transmitted; a second line on which a right channel signal is transmitted; a subtracting circuit which obtains a difference between signals on the first and second lines; a first changeover circuit which selectively outputs the signals on the first and second lines to first and second terminals in a combination in accordance with a mode; a second changeover circuit connected to an output of the subtracting circuit and to at least one of the first and second lines, said second changeover circuit selectively outputting a substraction signal and a signal which is on the line to which the second changeover circuit is connected, to a third terminal according to a mode; the third terminal and a fourth terminal connected to left and right speakers, respectively; a third changeover circuit which selectively outputs signals at the first, second and third terminals in a setting in accordance with a mode; and controlling means for detecting a level of the signal from the microphone to change a setting of the third changeover circuit when the level is equal to or lower than a predetermined value.

The mode (karaoke reproduction mode) which controls conditions of the first, second and third changeover circuits includes a vocal canceling mode for canceling a vocal signal so that only an accompaniment signal is left when left and right channel signals from the sound source each include both the accompaniment signal and the vocal signal, and a mode for outputting either the left channel signal or the right channel signal when one of the left and right channel signals includes the accompaniment signal and the other includes the vocal signal.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
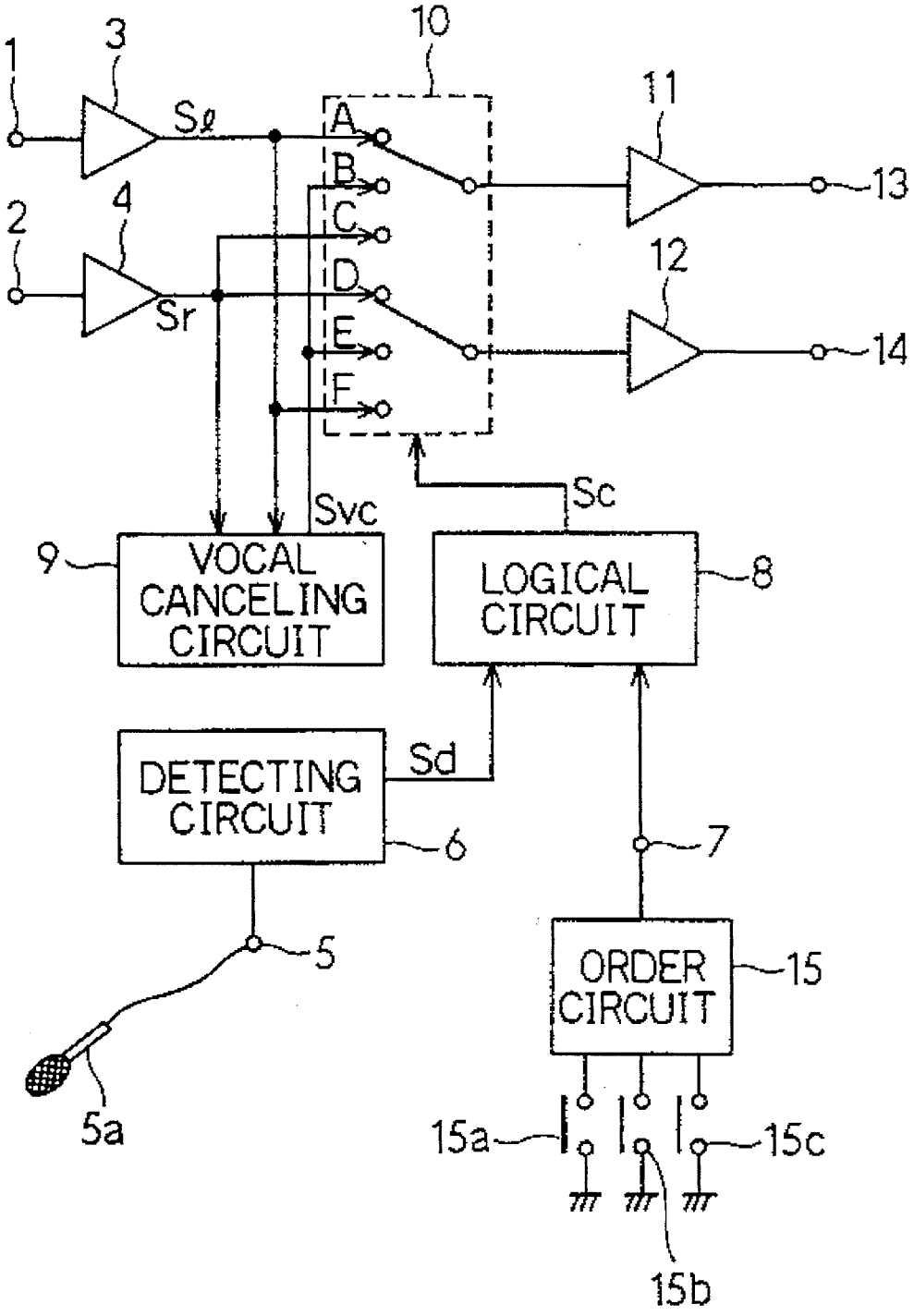
FIG. 1 PRIOR ART
FIG. 1 is a schematic block diagram of a relevant portion of an audio apparatus according to a prior art of the present invention.
Figure 2:
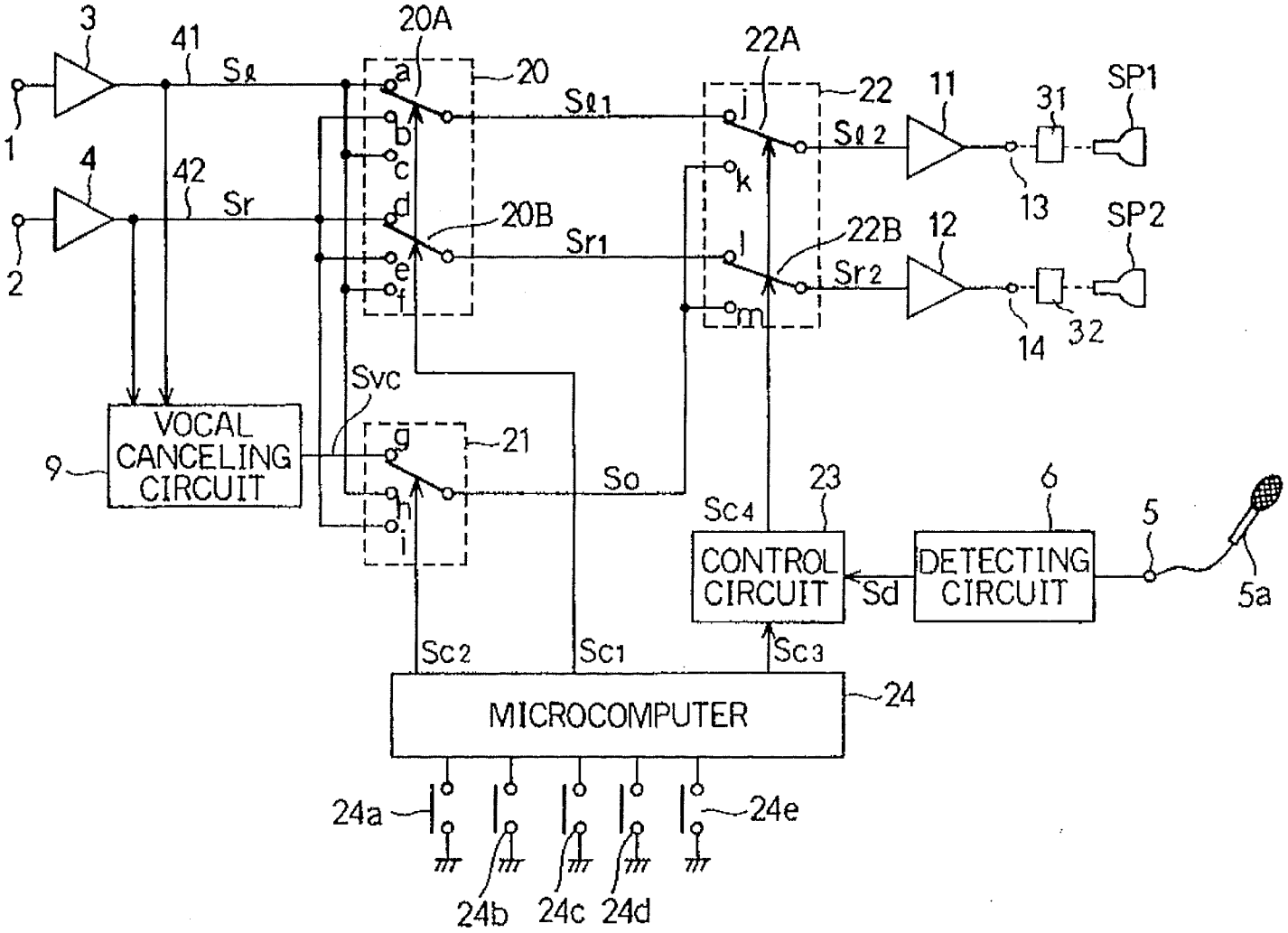
FIG. 2 is a schematic block diagram of a relevant portion of an audio apparatus according to an embodiment of the present invention.

Hereinafter, an embodiment of the present invention will be described with reference to the drawing. Referring to FIG. 2, there is shown a schematic block diagram of an audio apparatus according to an embodiment of the present invention. The following elements are the same as those of the conventional apparatus shown in FIG. 1: the left input terminal 1; the right input terminal 2; the left amplifier 3; the right amplifier 4; the microphone terminal 5; the detecting circuit 6; the vocal canceling circuit 9; the left buffer circuit 11; the right buffer circuit 12; the left output terminal 13; and the right output terminal 14. Mixing circuits 31 and 32 which add (superimpose) signals from the microphone 5*a* are provided between the terminal 13 and a speaker SP1 and between the terminal 14 and a speaker SP2, respectively.

In FIG. 2, reference numeral 20 represents a first switch, reference numeral 21 represents a second switch, and reference numeral 22 represents a third switch. The first and second switches 20 and 21 are directly controlled by first and second control signals Sc1 and Sc2 of ternary level outputted by a microcomputer 24. The third switch 22 is controlled by a third control signal Sc3. A control circuit 23 outputs a fourth control signal Sc4 when the detection signal Sd is outputted from the detecting circuit 6.

The microcomputer 24 outputs control signals Sc1, Sc2 and Sc3 according to operation of operation buttons 24*a*, 24*b*, 24*c*, 24*d* and 24*e*. The first switch 20 has its terminals a, c and f connected to a line 41 and has its terminals b, d and e connected to a line 42. The switch 20 includes two switches 20A and 20B. The second switch 21 has its terminal g connected to the vocal canceling circuit 9 and has its terminals h and i connected to the lines 41 and 42, respectively. The third switch 22 has its terminal j connected to the output of the switch 20A, has its terminal l connected to the output of the switch 20B and has its terminals k and m connected to the output of the switch 21. The switch 22 includes two switches 22A and 22B. The first, second and third switches are formed of semiconductor device circuits. The vocal canceling circuit 9 is formed of a subtracting circuit.

An operation of the audio apparatus of this embodiment thus structured will be described with respect to each operation mode set by the user.

First, a first operation mode in which the normal music reproduction is performed will be described. In this mode, none of the first operation button 24*a*, the second operation button 24*b*, the third operation button 24*c*, the fourth operation button 24*d* and the fifth operation button 24*e* is depressed.

At this time, the first control signal Sc1 is of H level, so that the first switch 20 is connected to terminals a and d and the output signals Sl1 and Sr1 are the same as the left and right signals Sl and Sr. The third control signal Sc3 is of H level and the fourth control signal Sc4 outputted by the control circuit 23 is of H level, so that the third switch 22 is connected to terminals j and l and the output signals Sl2 and Sr2 are the same as the signals Sl1 and Sr1. Consequently, the signal transmitted to the left output terminal 13 is the left signal Sl and the signal transmitted to the right output terminal 14 is the right signal Sr.

When the user performs karaoke, the first operation button 24*a* is depressed and the second operation button 24*b*, the third operation button 24*c*, the fourth operation button 24*d* and the fifth operation button 24*e* are operable. At this time, the user selects one of the second operation button 24*b* specifying the vocal canceling mode, the third operation button 24*c* specifying the sound multiple mode and the fourth operation button 24*d* specifying the reverse sound multiple mode. To set the vocal assisting mode in these modes, the user depresses the fifth operation button 24*e*.

First, a case will be described where the second operation button 24*b* is depressed to specify the vocal canceling mode using a sound source such as a normal compact disk. At this time, the first control signal Sc1 remains of H level and the output of the first switch 20 is the same as that of the normal music reproduction. The second control signal Sc2 transmitted to the second switch 21 is of H level and the switch 21 is connected to a terminal g, so that an output signal So of the second switch 21 is the accompaniment signal Svc. The signal So is supplied to terminals k and m of the third switch 22.

At this time, if the fifth operation button 24*e* specifying the vocal assisting mode is not depressed, the third control signal Sc3 is of L level and the fourth control signal Sc4 is of L level. Consequently, the third switch 22 is connected to the terminals k and m, so that the accompaniment signal Svc where the vocal signal has been canceled is outputted from the left and right output terminals 13 and 14.

If the fifth operation button 24*e* specifying the vocal assisting mode is depressed, the third control signal Sc3 is of M level, and the fourth control signal Sc4 is of L level when the detection signal Sd is not outputted and of H level when the detection signal Sd is outputted at a pause of the sound from the microphone 5*a*. Consequently, when sound is picked up by the microphone 5*a*, i.e. when the detection signal Sd is not outputted, the third switch 22 is connected to the terminals k and m, so that the accompaniment signal Svc is outputted from the left and right output terminals 13 and 14. When the sound from the microphone 5*a* pauses, i.e. the detection signal Sd is outputted, the third switch 22 is connected to the terminals j and l, so that the left and right signals Sl and Sr are outputted from the left and right output terminals 13 and 14.

Secondly, a case will be described where the sound multiple mode is selected by the user and the third operation button 24*c* is depressed. At this time, the first control signal Sc1 is of M level and the first switch 20 is connected to terminals b and e, so that the output signals Sl1 and Sr1 are both the right signal Sr including both the accompaniment and model vocal. The second control signal Sc2 is also of M level and the second switch 21 is connected to a terminal h. Consequently, the output signal So of the second switch 21 is the left signal Sl including only the accompaniment.

At this time, the third control signal Sc3 is of L level and the fourth control signal Sc4 outputted by the control circuit 23 is of L level. Consequently, the third switch 22 is connected to the terminals k and m, so that the signal transmitting to the left and right output terminals 13 and 14 are the left signal Sl, i.e. only the accompaniment is outputted.

When the fifth operation button 24*e* specifying the vocal assisting mode is depressed, like the case described previously, the third control signal Sc3 is of M level, and the fourth control signal Sc4 is of L level when the detection signal Sd is not outputted and of H level when the detection signal Sd is outputted at a pause of the sound from the microphone 5*a*. Consequently, when sound is picked up by the microphone 5*a*, the third switch 22 is connected to the terminals k and m, so that the signal Sl including only the accompaniment is outputted from the left and right output terminals 13 and 14. When the sound from the microphone 5*a* pauses, the third switch 22 is connected to the terminals j and l, so that the right signal Sr including both the accompaniment and model vocal is outputted from the left and right output terminals 13 and 14.

Thirdly, a case will be described where a mode to enjoy the reverse sound multiple karaoke (hereinafter, this mode will be referred to as "reverse sound multiple mode") is selected by the user and the fourth operation button 24*d* is depressed. At this time, the first control signal Sc1 is of L level and the first switch 20 is connected to terminals c and f, so that the output signals Sl1 and Sr1 are both the left signal Sl including both the accompaniment and model vocal. The second control signal Sc2 is also of L level, so that the second switch 21 is connected to a terminal i. Consequently, the output signal So of the second switch 21 is the right signal Sr including only the accompaniment.

At this time, the third control signal Sc3 is of L level and the fourth control signal Sc4 outputted by the control circuit 23 is of L level. Consequently, the third switch 22 is connected to the terminals k and m, so that the sound signal transmitted to the left and right output terminals 13 and 14 is the left signal Sr, i.e. only the accompaniment is outputted.

When the fifth operation button 24*e* specifying the vocal assisting mode is depressed, like the case described previously, the third control signal Sc3 is of M level, and the fourth control signal Sc4 is of L level when the detection signal Sd is not outputted and of H level when the detection signal Sd is outputted at a pause of the sound from the microphone. Consequently, when sound is picked up by the microphone 5*a*, the third switch 22 is connected to the terminals k and m, so that the right signal Sr including only the accompaniment is outputted from the left and right output terminals 13 and 14. When the sound from the microphone 5*a* pauses, the third switch 22 is connected to the terminals j and l, so that the left signal Sl including both the accompaniment and model vocal is outputted from the left and right output terminals 13 and 14.

While the switches are controlled based on the three-valued logic in this embodiment, they may be controlled based on the two-bit logic by using two signal lines. Other than this, this embodiment may be modified in various forms.

As described above, according to the present invention, a convenient audio apparatus is realized employable for all the karaoke sound sources on the market and not requiring the user to perform any additional operations.

Obviously, many modifications and variations of the present invention are possible in light of the above teachings. It is therefore to be understood that within the scope of the appended claims, the invention may be practiced other than as specifically described.

What is claimed is:

1. An audio apparatus having a plurality of modes as a karaoke reproduction to superimpose a sound signal from a microphone on an audio signal from a stereo sound source to be outputted to a speaker, said audio apparatus comprising:

a first line on which a left channel signal is transmitted;

a second line on which a right channel signal is transmitted;

a subtracting circuit which obtains a different between signals on the first and second lines;

a first changeover circuit which selectively outputs the signals on the first and second lines to first and second terminals in a combination in accordance with the modes;

a second changeover circuit connected to an output of the subtracting circuit and to at least one of the first and second lines, said second changeover circuit selectively outputting a substraction signal and a signal which is on the line to which the second changeover circuit is connected, to a third terminal according to the modes;

a fourth terminal and a fifth terminal connected to left and right speakers, respectively;

a third changeover circuit which selectively outputs signals at the first, second and third terminals in a setting in accordance with the modes; and controlling means for detecting a level of the signal from the microphone to change a setting of the third changeover circuit when the level is equal to or lower than a predetermined value.

2. An audio apparatus according to claim 1, wherein the modes which control conditions of the first, second and third changeover circuits includes a vocal canceling mode for canceling a vocal signal so that only an accompaniment signal is present when left and right channel signals from the sound source each include both the accompaniment signal and the vocal signal, and a mode for outputting either the left channel signal or the right channel signal when one of the left and right channel signals includes the accompaniment signal and the other includes the vocal signal.

3. An audio apparatus according to claim 2, wherein when said controlling means changes the setting of the third changeover circuit, the vocal signal and the accompaniment signal from the sound source are outputted to the fourth and fifth terminals, so that a vocal assisting mode is set.

4. An audio apparatus according to claim 1, wherein an operation member is provided for selecting a mode.

5. An audio apparatus capable of, in addition to an operation of a normal mode to perform stereo reproduction, karaoke reproduction to superimpose a sound signal from a microphone on an audio signal from a stereo sound source to be outputted to a speaker, said audio apparatus having as the karaoke reproduction a vocal canceling mode for canceling a vocal signal so that only an accompaniment signal is present when left and right channel signals from the sound source each include both the accompaniment signal and the vocal signal, a sound multiple mode for outputting the left channel signal when the left channel signal from the sound source includes the accompaniment signal and the right channel signal from the sound source includes the accompaniment signal and the vocal signal, and a reverse sound multiple mode for outputting the right channel signal when the left channel signal from the sound source includes the accompaniment signal and the vocal signal and the right channel signal includes the accompaniment signal, said audio apparatus comprising:

a first line on which the left channel signal is transmitted;

a second line on which the right channel signal is transmitted;

a subtracting circuit which obtains a difference between signals on the first and second lines;

a first changeover circuit which outputs the signals on the first and second lines to first and second terminals, respectively, in the normal mode and the vocal canceling mode, outputs the signal on the second line to the first and second terminals in the sound multiple mode, and outputs the signal on the first line to the first and second terminals in the reverse sound multiple mode;

a second changeover circuit which outputs an output signal of the subtracting circuit to a third terminal in the vocal canceling mode, outputs the signal on the first line to the third terminal in the sound multiple mode, and outputs the signal on the second line to the third terminal in the reverse sound multiple mode, a fourth terminal and a fifth terminal connected to left and right speakers, respectively;

a third changeover circuit which outputs signals at the first and second terminals to the fourth terminal and the fifth terminal in the normal mode, and outputs a signal at the third terminal to the fourth and fifth terminals in the vocal canceling mode, the sound multiple mode and the reverse sound multiple mode; and controlling means for detecting a level of the signal from the microphone in the vocal canceling mode, the sound multiple mode and the reverse multiple mode to output the signals at the first and second terminals to the fourth and fifth terminals when the level is equal to or lower than a predetermined level.

6. An audio apparatus having, as a karaoke reproduction to superimpose a sound signal from a microphone on an audio signal from a stereo sound source to be outputted to a speaker, a vocal canceling mode for canceling a vocal signal so that only an accompaniment signal is present when left and right channel signals from the sound source each include both the accompaniment signal and the vocal signal, a sound multiple mode for outputting the left channel signal when the left channel signal from the sound source includes the accompaniment signal and the right channel signal from the sound source includes the accompaniment signal and the vocal signal, and a reverse sound multiple mode for outputting the right channel signal when the left channel signal from the sound source includes the accompaniment signal and the vocal signal and the right channel signal from the sound source includes the accompaniment signal, said audio apparatus comprising:

a first line on which the left channel signal is transmitted;

a second line on which the right channel signal is transmitted;

a subtracting circuit which obtains a difference between signals on the first and second lines;

a first changeover circuit which outputs the signals on the first and second lines to first and second terminals, respectively, in the vocal canceling mode, outputs the signal on the second line to the first and second terminals in the sound multiple mode, and outputs the signal on the first line to the first and second terminals in the reverse sound multiple mode;

a second changeover circuit which outputs an output signal of the subtracting circuit to a third terminal in the vocal canceling mode, outputs the signal on the first line to the third terminal in the sound multiple mode, and outputs the signal on the second line to the third terminal in the reverse multiple mode;

a fourth terminal and a fifth terminal connected to left and right speakers;

a third changeover circuit which outputs a signal at the third terminal to the fourth terminal and a fifth terminal in the vocal canceling mode, the sound multiple mode and the reverse sound multiple mode; and controlling means for detecting a level of the signal from the microphone in the vocal canceling mode, the sound multiple mode and the reverse multiple mode to output signals at the first and second terminals to the fourth and fifth terminals when the level is equal to or lower than a predetermined level.

* * * * *